United States Patent [19]

Teruyama

[11] 4,281,974

[45] Aug. 4, 1981

[54] SEAL MECHANISM IN GEAR PUMPS OR MOTORS

[75] Inventor: Hideo Teruyama, Shobu, Japan

[73] Assignee: Kayabakogyokabushikikaisha, Tokyo, Japan

[21] Appl. No.: 76,783

[22] Filed: Sep. 18, 1979

[30] Foreign Application Priority Data

Sep. 19, 1978 [JP] Japan ..... 53-114831

[51] Int. Cl.[3] ..... F03C 2/08; F04C 2/18; F04C 15/00

[52] U.S. Cl. ..... 418/132

[58] Field of Search ..... 418/131, 132

[56] References Cited

U.S. PATENT DOCUMENTS

| | | | |
|---|---|---|---|
| 2,816,510 | 12/1957 | Jarvis | 418/132 |
| 2,824,522 | 2/1958 | Compton | 418/132 |
| 2,842,066 | 7/1958 | Hilton | 418/132 |
| 3,748,063 | 7/1973 | Putnam | 418/132 |
| 3,891,360 | 6/1975 | Dworak et al. | 418/132 |

FOREIGN PATENT DOCUMENTS

| | | | |
|---|---|---|---|
| 2803672 | 8/1978 | Fed. Rep. of Germany | 418/132 |
| 52-76707 | 6/1977 | Japan | 418/132 |

*Primary Examiner*—John J. Vrablik
*Attorney, Agent, or Firm*—Saul Jecies

[57] ABSTRACT

A seal mechanism in gear pumps or motors, in which a pair of gears engage, so that at least one side surface of these gears is sealed by a pressure plate movable in the direction of the shaft, the said pressure plate is partitioned by a seal member in the shape of a figure "3" at the back into the low pressure zone and the high pressure zone which lead to the inlet side pressure and the outlet side pressure, respectively, both ends of the said seal member are formed in a loop-like shape, and block members for backup use, movable with respect to the pressure plate, are housed in the loop-like parts, so that the said block members may be pressed toward the low pressure side through the seal member by the liquid pressure which is connected to the high pressure zone during the operation of the gear pump or motor, so that these block members may press the end parts of the seal member to the inner wall surface of the gear bower in the housing and so that no liquid may leak from these parts.

4 Claims, 4 Drawing Figures

SEAL MECHANISM IN GEAR PUMPS OR MOTORS

BACKGROUND OF THE INVENTION

The present invention relates to a seal mechanism in gear pumps or motors of a type such that it includes a pressure plate partitioned with a figure-3 shaped seal member at the back into a high pressure zone and a low pressure zone. Furthermore, in detail, the present invention relates to an improved seal mechanism of this type that facilitates the assembly work of gear pumps or motors without permitting either of the end parts of the figure-3 shaped seal member disposed at the back of the pressure plate to exert any substantial initial pressure on the inner wall surface of the gear bower in the housing in the assembly work during the operation of the gear pump or motor, permits the liquid pressure in the high pressure zone of the pressure plate to press both end parts of the said seal member to the inner wall surface of the gear bower so as to prevent completely the leakage of any liquid leak from these parts.

In general, for gear pumps or motors, the following two types of seal mechanism are known. One is seen, for instance, in Specifications of U.S. Pat. Nos. 3,539,282, 3,891,360 and 4,029,446 incorporates a pair of mutually engaging gears, each shaft of which is supported, rotating freely, by a bearing block inserted movably against the gear bower in the housing, while the other is seen, for instance, in U.S. Pat. Nos. 3,270,680, 3,473,476 and 3,890,068, incorporates a pair mutually engaging gears, at least one side of which is in contact with a pressure plate, movable along the direction of the shaft, each of the gear shafts being supported by a fixed bushing fitted in the end wall of the housing or the end cover. In either of these types, the said bearing block or pressure plate is partitioned at the back with a figure-3 shaped seal member into a high pressure zone and a low pressure zone so that, during the operation of the gear pump or motor, a proper balance may be kept between the liquid pressures acting on both sides of the bearing block or the pressure plate and so that the gear side surface may be sealed completely.

In relation to gear pumps or motors of the latter type, described above, that include a pressure plate and particularly with reference to the assembly formed by inserting the end surface of each bushing fitted in the end cover into the shaft hole of the said pressure plate as seen in Specification of U.S. Pat. of 2,809,592, the present invention has been developed to facilitate the assembly work while securing reliable sealing.

Namely, in gear pumps or motors of this type, if an initial tension is imparted to both end parts of the figure-3 shaped seal members during assembly, so as to secure the required sealing performance, the figure-3 shaped seal members may be deformed due to this initial tension when they are fitted in the gear bower of the housing. Therefore, when the end cover is fitted to the housing, there is a danger that the end of the bushing fitted in the said end cover may interfere and impair the deformed seal member, degrading its sealing performance. Thus, the assembly work requires careful attention and particular skill. In order to simplify the assembly work, therefore, it is not advisable to impart an initial tension to the said seal member at both ends.

For above reason, in gear pumps or motors of this type, both end parts of the figure-3 shaped seal member are kept just in touch with the inner wall surface of the gear bower in the housing to form the seal. As a result, during the operation of such gear pumps or motors, liquid in the high pressure zone at the back of the pressure plate may leak toward the low pressure zone through both end parts of the figure-3 shaped seal member. In other words, there is a defect in that the gear pump or motor suffers an impaired volumetric efficiency, that erosion is caused at the point of leakage, on the pressure plate or that the liquid pressure builds up in the low pressure zone, jeopardizing the pressure balance and giving rise to serious problems with respect to the performance and service life of the gear pump or motor.

SUMMARY OF THE INVENTION

As stated above, the primary purpose of the present invention is to offer an improved seal mechanism for gear pumps or motors of this type that both simplifies their assembly and effectively prevents the leakage of liquid from both end parts of the figure-3 shaped seal member.

Another purpose of the present invention is to achieve an effective pressure balance across parts subject to different pressures that arise during operation of gear pumps or motors by means of the seal mechanisms at both end parts of the figure-3 shaped seal member.

An additional purpose of the present invention is to offer a mechanism that facilitates the assembly of gear pumps or motors by manufacture; forcibly correcting any deformation that may be present after molding when the figure-3 shaped seal member is fitted.

In the present invention, therefore, both end parts of the figure-3 shaped seal member are formed in a loop-like shape, and a block member for backup use, movable with respect to the pressure plate, is housed in each loop-like part. Thus, during operation of the gear pump or the motor, both end parts of the figure-3 shaped seal member are pressed strongly by the block member for backup use against the inner wall surface of the gear bower in the housing, preventing the leakage of any liquid leak from this part precisely because these block members move toward the low pressure zone under the action, through the seal member, of the liquid pressure introduced to the high pressure zone at the back of the pressure plate even if no initial tension has been imparted to both end parts of the figure-3 shaped seal member with the aim of facilitating the assembly of the gear pump or motor. In addition, the pressure balance across these parts subject to different pressures may be achieved more effectively by locating the loop-shaped parts at both ends of the said figure-3 shaped seal member appropriately with respect to tooth grooves which produce varieties of pressure in accordance with the operation of the gear pumps or motors and by introducing the liquid pressure produced by the tooth grooves to the said loop-shaped part via a hole through the pressure plate. Furthermore, by providing the figure-3 shaped seal member with a fin at the back which matches the gear bower in the housing, it is made possible, when these seal members are fitted, to forcibly correct any deformation occurring after manufacture and eventually to facilitate the assembly of the gear pump or motor.

In the following, examples of the applications of the present invention will be further described with reference to the drawings attached. Although the present invention is described for gear pumps, the principle is naturally applicable, without modification, to gear motors.

Figure 1:
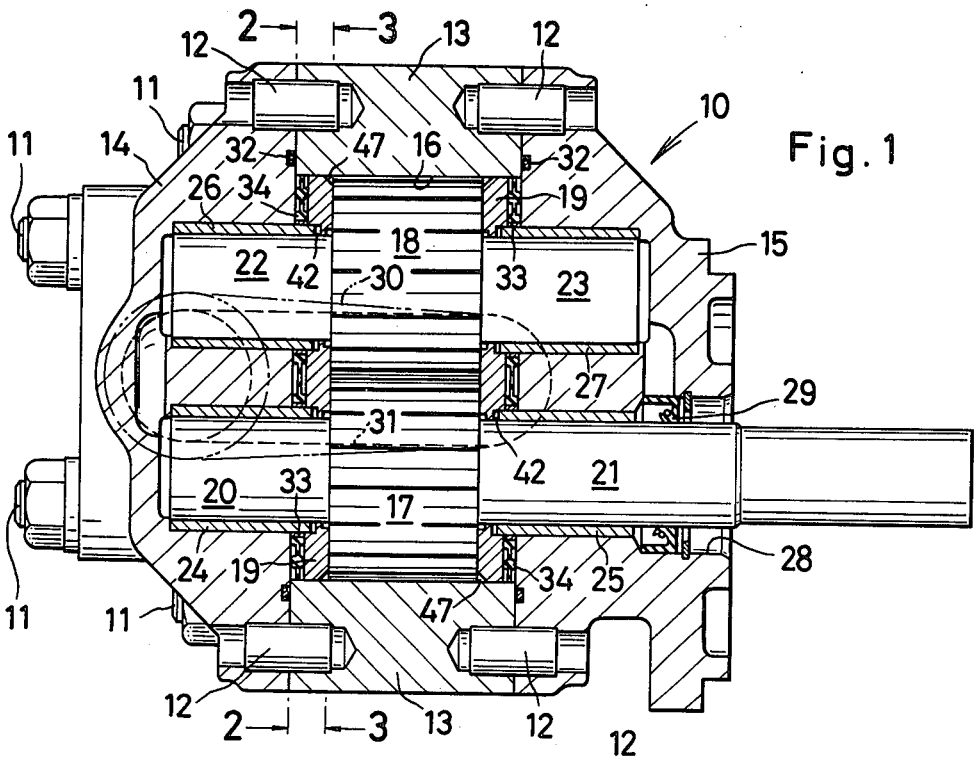
FIG. 1 represents a vertical front section of a gear pump showing an application example of the present invention.

DESCRIPTION OF THE PREFERRED EMBODIMENTS:

In FIG. 1, a gear pump 10 according to the present invention has a housing 13 and end covers 14, 15 which are assembled with the bolts 11 and kept in the setting condition with dowel pins 12.

In the housing 13, a figure-8 shaped gear bower 16 forms the pumping action chamber that houses a pair of gears 17, 18, the pumping element, and a pair of pressure plates 19 which are movable in the direction of the shaft so as to seal closely both side surfaces of the gears 17, 18. Tooth crests of the gears 17, 18 as well as the upper and lower circumferential surfaces of the pressure plate 19 slide exactly in contact with the inner wall surface of the gear bower 16 in the housing 13.

The gears 17, 18 have shafts 20, 21 and 22, 23 at both sides, respectively, and the shaft 20–23 pass through the pressure plates 19 and are supported, rotating freely, in bushings 24, 26 and 25, 27 which are fitted within the end covers 14, 15. The shaft 21 of the gear 17 protrudes outward through a shaft hole 28 in the end cover 15, so that it may be connected to a power source external to the gear pump 10. In the shaft hole 28 of the end cover 15, through which the said shaft 21 passes, there is an oil seal 29 so as to seal tightly the clearances between the shaft 21 and the shaft hole 28.

In order to receive the liquid from outside as the gear pump 10 operates, and in order to pressurize and discharge it to the outside again, a liquid inlet passage 30 and a liquid outlet passage 31 are provided, which lead from the end cover 14 to the housing 13 and to the middle of the other end cover 15 as shown by a broken line and a dotted line in FIG. 1, respectively. These passages 30, 31 connect both sides of the gear bower 16 in the housing 13 and form outside ports for suction and delivery of the liquid.

In the respective surfaces of contact between the housing 13 and end cover 14, and between the said housing 13 and end cover 15, there are O-rings 32 surrounding the gear bower 16 of the housing 13 and the said liquid inlet and outlet passages 30, 31, so that the gear bower 16 is sealed tightly and insulated from the outside by the O-rings 32.

Figure 2:
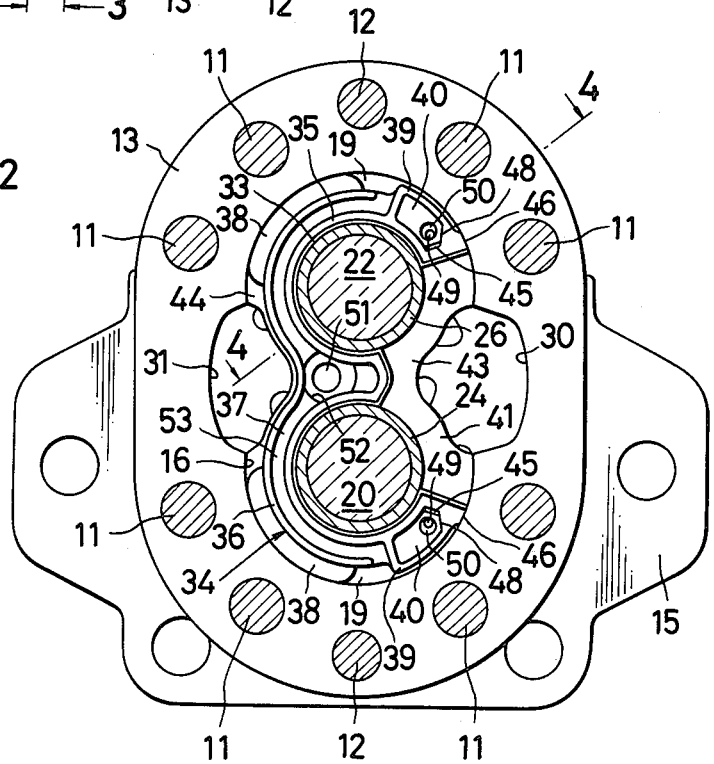
FIG. 2 represents a vertical side section along the line 2—2 in FIG. 1.
Figure 3:
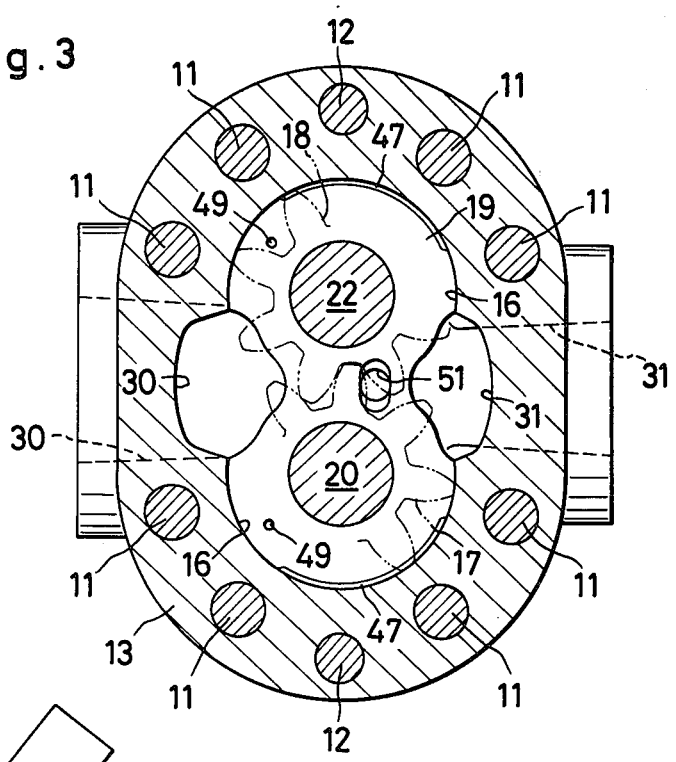
FIG. 3 represents a vertical side section along the line 3—3 in the same FIG. 1.

As shown in FIGS. 1 and 2, at the back surface of the said pressure plate 19, i.e., between its end surface opposite to the gears 17, 18 and the end covers 14, 15, are arranged figure-3 shaped seal members 34, each of which has a backup member 33 inside it.

As it is indicated clearly in FIG. 2, the said figure-3 shaped seal member 34 consists of an inner rising part 35 extending for almost $\frac{3}{4}$ of the outer circumference of the bushings 24–27 of the end covers 14, 15, an outer rising part 36 arranged outside at a proper distance from the said inner rising part 35, the first fin part 37 connecting these inner and outer rising parts 35, 36 and the second fin part 38 extending outward from the back of the outer rising part 36. However, it should be noted particularly that the figure-3 shaped seal member 34 is provided with the inner rising part 35 and both ends of the said inner rising part 35 are formed into loop-like parts 39 and that each of these loop-like parts 39 houses a block member 40 for backup use, movable with respect to the pressure plate 19.

The seal member 34, which carries the backup member 33, and the block member 40 are both fitted together, by means of an isolation plate 41, to the gear bower 16 located at the back of the pressure plate 19 before the end covers 14, 15 are fitted to the housing 13. After that, when the end covers 14, 15 are fitted to the housing 13, as seen in FIG. 1, each end of the bushings 24–27 fitted within these end covers 14, 15 is passed through the inner surface of the arc part of the backup member 33 and are fitted in a recess 42 arranged at the back of the pressure plate 19.

Thus, as seen clearly from FIG. 2, the seal member 34 is supported along the inner surface of its arc part by the bushings 24–27 through the medium of the backup member 33 and, along the remaining inner end surface, by the isolation plate 41. Since the inner and outer rising parts 35, 36 and the loop-like part 39 are pressed between the back of the pressure plate 19 and the inner surface of the end covers 14, 15, they work together with the O-ring 32 to partition the back of the pressure plate 19 into the low pressure zone 43 leading to the liquid inlet passage 30, the high pressure zone 44 leading to the liquid outlet passage 31, and a chamber 45 enclosed by the loop-like part 39.

Should the seal member 34 which carries the backup member 33 have any deformation, it may be understood from the above explanation that when each end of the bushings 24–27 fitted within the end covers 14, 15 is passed through the inner surface of the arc part of the backup member 33 and fitted in the recess 42 at the back of the pressure plate 19, the ends of the said bushings 24–27 may hit the backup member 33 or the seal member 34, presenting a danger not only of making it difficult to fit the end cover 14, 15, but also of damaging the seal member 34 and consequently degrading the sealing performance. For this reason, the seal member 34 is formed precisely beforehand so as to match the outer circumferential surface of bushings 24–27 within the end cover 14, 15 as well as the inner surface of the gear bower 16 in the housing 13, so that the end seal part 46 of the loop-like part 39 may exert little initial tension on the inner wall surface of the gear bower 16 when the seal member 34 is fitted into the gear bower 16. In other words, any deformation of the seal member 34 due to the initial tension of the end seal part 46 is avoided. Thus, the fitting of end covers 14, 15 to the housing 13 is facilitated and the assembly work of the gear pump 10 may be carried out precisely and quickly.

Even if the seal member 34 is precisely formed as above, however, it may sometimes be deformed after molding. In this case, the second fin part 38 added to the seal member 34 comes into operation. Namely, since the second fin part 38 is formed beforehand so that its outer circumferential surface may match the inner wall surface of the gear bower 16, the second fin part 38 functions to correct any deformation after molding of the seal member 34 when the seal member 34 is fitted to the gear bower 16.

During the operation of the gear pump 10, when the shaft 21 is driven and rotated by an external power source, the gear 17 drives the outer gear 18, and the liquid which is introduced through the liquid inlet passage 30 is caught in tooth grooves, the radial space of the gears 17, 18, and discharged around the inner wall of the gear bower 16 to the liquid outlet passage 31.

As the liquid pressure in the liquid outlet passage 31 increases, the gears 17, 18 are pressed toward the liquid inlet passage 30 and, in the liquid outlet passage 31 side, tooth crests of the gears 17, 18 part from the inner wall surface of the gear bower 16, so that the high pressure liquid in the liquid outlet passage 31 is introduced through the well known device of a speed slot 47, which is formed in the pressure plate 19 as shown in FIG. 3, and so that the liquid pressure in the tooth grooves of these parts is equalized with that in the liquid outlet passage 31. On the other hand, in the liquid inlet passage 30, tooth crests of the gears 17, 18 are pressed to the inner wall surface of the gear bower 16, and these tooth crests of the gears 17, 18 break-in the inner wall surface of the gear bower 16 in the initial preliminary operation of the gear pump 10 and intercept the connection between the liquid inlet passage 30 and the liquid outlet passage 31. Thus, around the gears 17, 18 are formed parts subject to different pressures, where the liquid pressure in the tooth grooves adjacent to the liquid inlet passage 30 changes from low to high, and parts under constant high pressure, where the liquid pressure in the tooth grooves is maintained the same as that in the liquid outlet passage 31, and the pressure plate 19 is pressed by the liquid pressure of these parts towards the end covers 14, 15.

At the same time, since the force on the pressure plate 19 is counteracted so as to keep at a proper level the pushing force or pressure loading on the said pressure plate 19 forcing it against the gear side surface, the low liquid pressure of the liquid inlet passage 30 connects with the low pressure zone 43 partitioned by the seal member 34 at the back of the pressure plate 19, while the high liquid pressure in the liquid outlet passage 31 connects with the high pressure zone 44 at the back of the said pressure plate 19. Thus, these liquid pressures act so as to press the pressure plate 19 to the gear side surface with proper strength, causing the pressure plate 19 to seal the gear side surface.

Therefore, in cases where no initial tension is imparted to the end seal part 46 of the seal member 34, so as to facilitate the assembly work of the said gear pump 10, the high pressure liquid in the high pressure zone 44 leaks out to the low pressure zone 43 through the end seal part 46, not only jeopardizing the loading balance of the pressure plate 19, but also causing erosion to the leaking part of the pressure plate 19 or degradation in the volumetric efficiency of the gear pump 10. In the case of the present invention, however, the block member 40 housed in the loop-like part 39 of the seal member 34 moves toward the isolation plate 41 under the action of the liquid pressure in the high pressure zone 44 through the seal member 34 and forces the seal member 34 part against the isolation plate 41 so as to press the end seal part 46 strongly against the inner wall surface of the gear bower 16. Thus, the higher the liquid pressure of the liquid outlet passage 31, the more strongly does the end seal part 46 of the seal member 34 become pressed against the inner wall surface of the gear bower 16, so that the liquid passing through this part may be prevented from leaking completely, while the tension of the end seal part 46 is varied according to the liquid pressure of the liquid outlet passage 31. Therefore, it is quite clear that the abovementioned effect is produced more precisely by giving a tapered face 48 to the end part of the block member 40 and by keeping it in contact with the loop-like part 39 of the seal member 34 as seen in FIG. 2.

Figure 4:
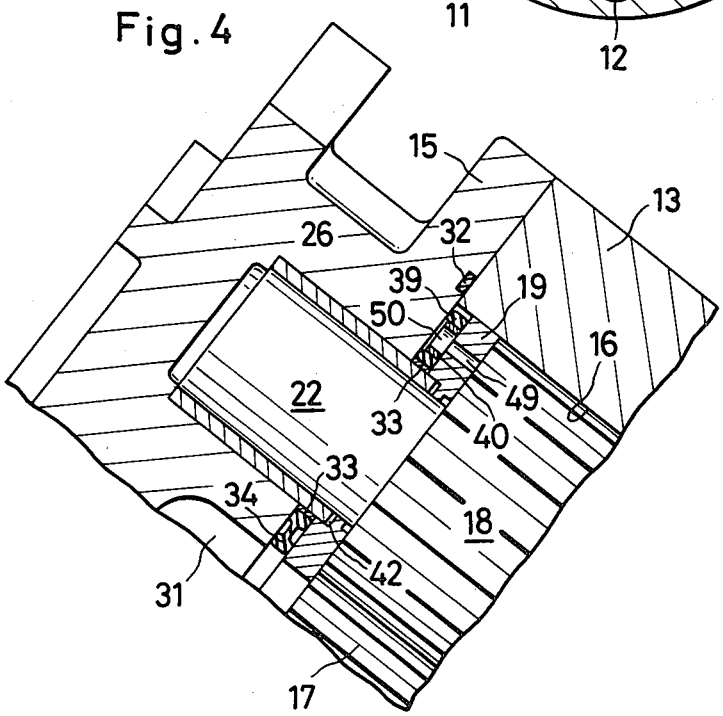
FIG. 4 represents an enlarged partial vertical section along the line 4—4 in FIG. 2.

Thus, the gear pump 10 according to the present invention is easy to assembly and excellent in efficiency and durability. However, since there are parts subject to different pressures in the tooth grooves adjacent to the liquid inlet passage 30, as mentioned above, during the operation of the gear pump 10, this constitutes a factor that can degrade the loading balance on the pressure plate 19. For this reason, in the present invention, the loop-like part 39 of the seal member 34 is located opposite the said parts subject to different pressures so that the liquid pressure in tooth grooves passing these parts may be led to the chamber 45 enclosed by the loop-like part 39 via a hole 49 passing through the pressure plate 19 as shown in FIG. 4 and so that a more favorable pressure loading may act upon the pressure plate 19. In this case, however, as the liquid pressure in the chamber 45 changes from high to low according to the liquid pressure in the tooth grooves passing through the parts subject to different pressures, there is a danger that the block member 40 housed in the chamber 45 may be pressed to the back of the pressure plate 19, blocking the hole 49 and thus preventing the liquid pressure in the chamber 45 from lowering. Nonetheless, this danger may be avoided by providing the block member 40 with a passage 50 which constantly maintains its upper surface always in line with the hole 49.

In the above application example, though there is no direct relation to the point of the present invention, in order to prevent chips, which are produced from the housing 13 by the tooth crests of the gears 17, 18 as they are "broken in" during the preliminary operation of the gear pump 10, from staying in the high pressure zone 44 shown in FIGS. 2 and 3, the part enclosed by the engaging gears 17, 18 is connected, through a hole 51 bored in the pressure plate 19 and another hole 52 bored at the center of the first fin part 37 of the seal member 34, to the central part of a passage part 53 provided between the inner and outer rising parts 35, 36 of the seal member 34, and both ends of this passage part 53 are connected to the liquid outlet passage 31 along the inner wall surface of the gear bower 16. In this way, during the operation of the pump 10, the liquid as pressurized at the part enclosed by the engaging gears 17, 18 flows from the holes 51, 52 always to the liquid outlet passage 31 along passage part 53 and the inner wall surface of the gear bower 16, so that the said braking-in chips from the housing 13 are prevented from remaining in the high pressure zone 44.

We have described above a preferred embodiment of the present invention. As previously noted, however, it is quite clear that the present invention is applicable not only to gear motors of the same type but also to such gear pumps or motors as are provided with a pair of engaging gears only at one side surface as seen, for instance, in Specifications of U.S. Pat. No. 3,270,680.

What is claimed is:

1. A seal mechanism for use between pressure plates and end plates of the housing of a gear pump or motor, comprising a seal member having the shape of a figure 3 and being adapted to subdivide the interior of the pump or motor into a high-pressure zone and a low-pressure zone, said seal member having a body and spaced ends each provided with a loop-shaped portion which surrounds a space; a plate member engaging said spaced ends, and a block member accommodated in each of said spaces and movable relative to the respectively adjacent pressure plate, each of said block members having a free end facing in direction away from said body and provided with a face which tapers in said direction whereby fluid pressure from said high pressure zone acting on said body forces the loop-shaped portions and block members against the plate member so that said tapered faces press the loop-shaped portions.

2. A mechanism as described in claim 1, in which said seal member has a fin part fitting an inner wall surface of a housing gear chamber.

3. A mechanism as described in claim 1, in which said loop-shaped portions of the seal member are located opposite to the part subject to different pressures, and liquid pressure in tooth grooves passing the said part is led to a chamber enclosed by the loop-like part.

4. A mechanism as described in claim 3, in which a passage means is provided having an upper surface always in line with a hole communicating the liquid pressure in the said tooth groove to the chamber enclosed by the loop-shaped part.

* * * * *